US005342038A

United States Patent [19]

Suter

[11] Patent Number: 5,342,038

[45] Date of Patent: Aug. 30, 1994

[54] APPARATUS FOR GATHERING INDIVIDUAL SHEETS INTO A BUNDLE

[76] Inventor: Walter Suter, Inglikerstrasse 39, CH-8142 Uitikon-Waldegg, Switzerland

[21] Appl. No.: 43,219

[22] Filed: Apr. 5, 1993

[30] Foreign Application Priority Data

May 15, 1992 [CH] Switzerland ..... 1566/92

[51] Int. Cl.[5] ..... B65H 43/04

[52] U.S. Cl. ..... 271/198; 271/223; 271/305; 414/790.7

[58] Field of Search ..... 271/198, 272, 213, 220, 271/223, 303, 305; 414/790.7

[56] References Cited

U.S. PATENT DOCUMENTS 3,785,256 1/1974 Suter ..... 414/790.7 X
4,640,506 2/1987 Luperti et al. ..... 414/790.7 X
4,925,180 5/1990 Golicz ..... 414/790.7 X
5,083,769 1/1992 Young, Jr. ..... 271/303 X

*Primary Examiner*—Robert P. Olszewski
*Assistant Examiner*—Boris Milef
*Attorney, Agent, or Firm*—Sughrue, Mion, Zinn, Macpeak and Seas

[57] ABSTRACT

A stacking apparatus has lower and upper continuous, rotating elastic cords 10, 11, between which delivered sheets 2 are conveyed to a pair of transport rollers 3. The rollers 20, 21 of the pair have wedge-shaped recesses 26, 27 with stop shoulders 28, 29, which are in alignment when the rollers are in their normal or rest position. The sheets strike these shoulders and stack up into a bundle 55, which is transported away in response to a discharge signal by the synchronous rotation of the rollers through an integral number of revolutions. The apparatus enables an efficient gathering of sheets into a precisely aligned bundle, which facilitates further processing.

9 Claims, 5 Drawing Sheets

APPARATUS FOR GATHERING INDIVIDUAL SHEETS INTO A BUNDLE

BACKGROUND OF THE INVENTION

For text processing and the computer-controlled assembly of documents for mailing, the sheets are marked by a printer, e.g. a laser printer, attached to the computer. Subsequently, they have to be collated, e.g. in the case of multi-sided documents according to their order of sequence, into a bundle or stack, and finally folded jointly or further processed and/or put into envelopes.

This invention is based on the problem of providing a device with which the individual sheets can be gathered efficiently and accurately, aligned one on top of the other, and subsequently can be conveyed together, e.g. into a folding and envelope stuffing machine.

DETAILED DESCRIPTION OF THE PREFERRED EMBODIMENT

Figure 1:
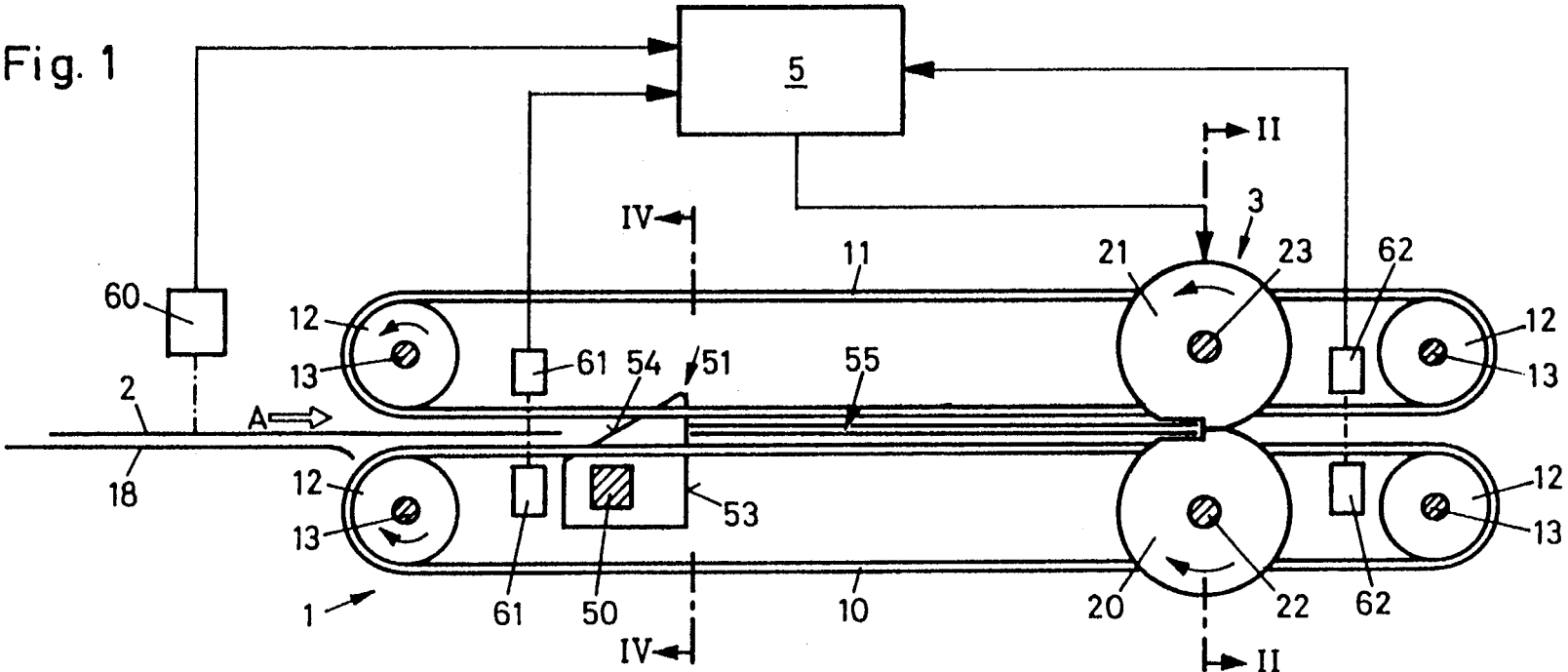
FIG. 1 is a diagrammatic longitudinal view of an apparatus in accordance with the invention.

Referring to FIGS. 1 through 4 of the drawings, the apparatus comprises a feed member i for feeding individual sheets 2 in the conveying direction A, two pairs of transport rollers 3, a drive 4 for the pairs of rollers 3, and a controller 5 to control the drive 4. The components of the apparatus are mounted in or on a housing 6 that is only partially illustrated.

The feed member i includes a plurality of continuous lower and upper elastic cords 10, 11, which are guided by deflecting rollers 12. The rollers 12 can be moved laterally and stopped or locked on shafts 13. The bottom run of the upper cords 11 runs parallel to the top run of the lower cords 10. The upstream shafts 13 are coupled together in counterrotation by gearwheels 14 and driven by a toothed belt 15 and other gearwheels 16 by a constantly rotating motor 17. The cords 10, 11 extend in the conveying direction beyond the pairs of rollers 3. The sheets 2 are fed to the draw-in gap of the cords 10, 11 by a guide plate 18, e.g. from a cross cutter or directly from a printer.

Figure 1A:
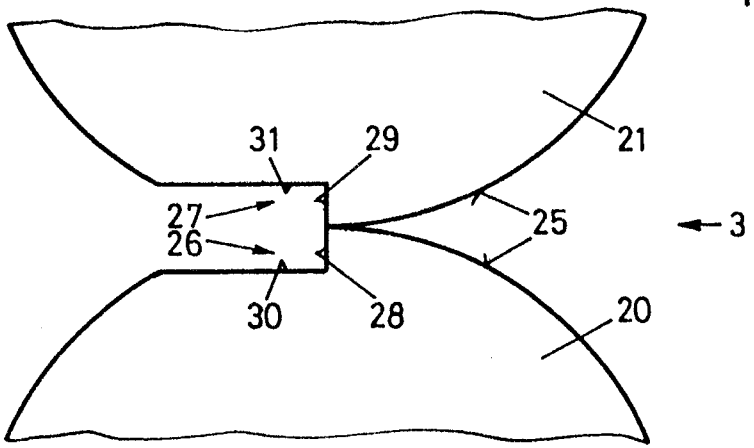
FIG. 1*a* is an enlarged view of a portion of FIG. 1.
Figure 2:
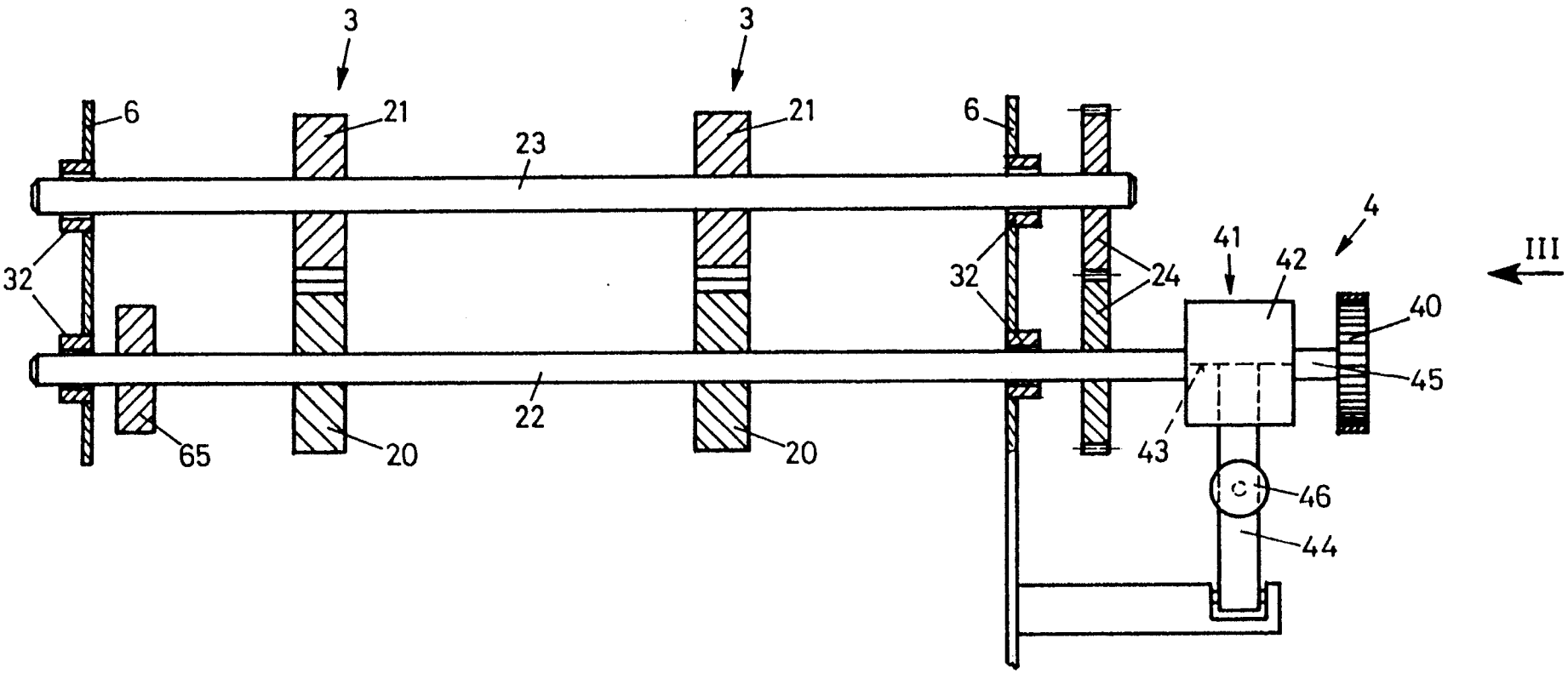
FIG. 2 is a sectional view taken along line II—II in FIG. 1.
Figure 3:
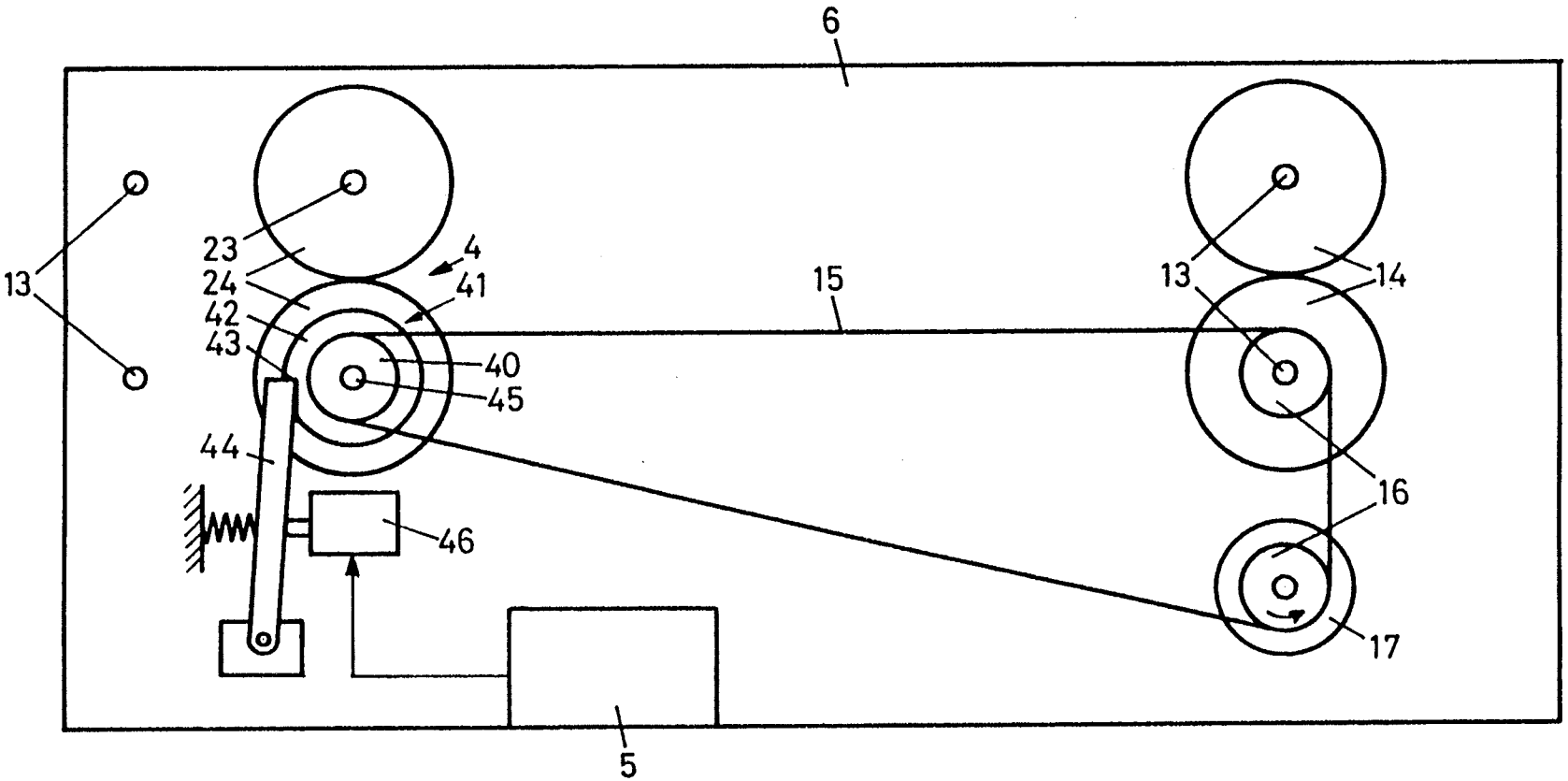
FIG. 3 is a view taken in the direction of arrow III in FIG. 2.
Figure 4:
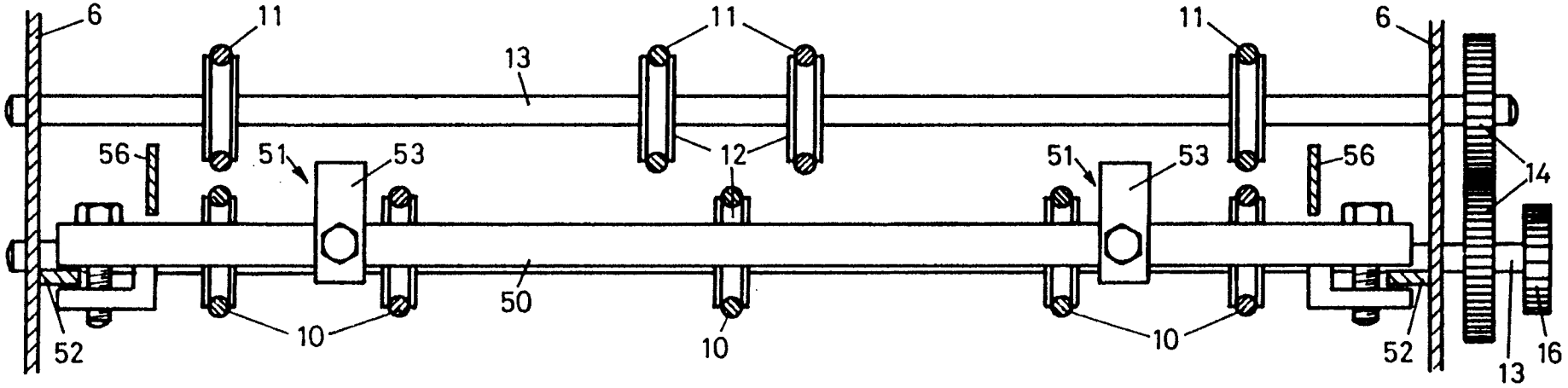
FIG. 4 is a sectional view taken along line IV—IV in FIG. 1.

The rollers 20, 21 of the pairs of transport rollers 3 are mounted on two shafts 22, 23, arranged one above the other in the housing 6. The shafts 22, 23 are coupled together in counterrotation by gearwheels 24. The outer cylindrical circumference 25 of each roller 20, 21 has a wedge-shaped recess 26, 27 with a stop shoulder 28, 29, which lies in a plane containing the axis of the roller, and a perpendicular, axially parallel surface 30, 31. In the normal or rest position of the rollers 20, 21 shown in FIGS. 1 and 1*a*, the stop shoulders 28, 29 lie in a common vertical plane. The distance between the bearings 32, which are attached to the housing and journal the shafts 22, 23, is somewhat less than the diameter of the rollers 20, 21, so that they can be readily pressed against each other due to the transverse elasticity of the shafts. As an alternative, the upper shaft 23 can also be spring or shock mounted vertically. The drive 4 includes another gearwheel 40, which is driven by the toothed belt 15 and is coaxial to the shaft 22. A one-stop clutch 41 connects the gearwheel 40 to the shaft 22.

The one-stop clutch 41 has a cylindrical housing 42 with an index notch 43, with which in the normal position a spring-loaded pawl 44 engages and thus stops the housing 42. The housing 42 is fixedly connected to the shaft 22 for rotation therewith. Within the housing 42 there is a spring band coupling, which is released when the index notch 43 strikes against the pawl 44, and which and connects the housing 42 to the shaft 45 of the gearwheel 40 for rotation therewith when the pawl 44 is lifted off. Such one-stop clutches are commercially available. The pawl 44 can be pushed out of the index notch 43 by an electromagnet 46, so that the shafts 22, 23 are driven by the continuously turning gearwheel 40 until the magnet 46 is deenergized and the pawl 44 locks into the index notch 43, and the rollers 20, 21 are again in the normal position shown in FIGS. 1 and 1*a*.

A sheet 2 fed into the draw-in gap of the cords 10, 11 is conveyed through the cords up to the point at which its front edge abuts the stop shoulders 28, 29. To lead the next sheet 2 over the first sheet and to prevent the sheets 2 from rebounding from the stop shoulders 28, 29, multiple rear stops 51 can be slid sideways on a cross bar 50 and fixed in a desired position(s). The bar 50 can be clamped adjustably in the advance direction A at two tracks 52, which are attached to the housing. The stops 51 project beyond the bottom run of the upper cords 11 and have a vertical stop face 53, facing the roller pairs 3, and a wedge-shaped, sloped abutting surface 54, facing upstream. The sheets 2 are guided between two side guide plates 56.

When a new sheet 2 is fed in, it is lifted by the abutting surfaces 54 of the rear stops 51 above the sheets 2, already gathered into a bundle between the stop shoulders 28, 29 and the stop faces 53, the bottom run of the upper cords 11 being deflected upwardly. As soon as the new sheet 2 strikes the shoulders 28, 29, its rear edge is pressed downwardly by the cords 11 behind the stops 51, so that the sheets 2 cannot rebound.

In operation, if, e.g. continuous forms are fed in from a preceding device with two edge cutters for severing punched outer strips and a cross cutter, then machine-readable marks, e.g. bar codes, which identify the last sheet of the bundle 55 to be gathered, can be put on the outer strips to be cut off. These marks are recognized by a reader 60, whose output activates the controller 5 to discharge the bundle. A photosensor 61 immediately upstream of the stop faces 53 informs the controller 5 of the passage of the rear edge of the last sheet. In response, the magnet 46 which unlocks the one-stop clutch 41, is switched on by a control pulse. The rollers 20, 21 are then released to rotate, and discharge the bundle 55. Due to the elasticity of the shafts 22, 23, the rollers 20, 21 can be vertically displaced to accommodate the thickness of the bundle. Directly downstream of the rollers 20, 21 is another photosensor 62, which keeps the magnet 46 energized via the controller 5, until the rear edge of the bundle 55 has passed. As soon as this has occurred, the magnet 46 is deenergized, and the pawl 44 stops the clutch 41 in its rest position. The number of revolutions completed by the clutch and rollers is thus adapted automatically to the length of the sheet bundle.

By means of the described apparatus individual sheets can be gathered efficiently and with little equipment into an accurately aligned bundle, and can be further transported as a bundle. Thus, the further processing of the bundle, e.g. in a folding and envelope stuffing machine, is greatly facilitated.

The total height of the stop shoulders 28, 29 is somewhat greater than half the maximum thickness of the bundle. If only a few sheets 2 have to be gathered, it is expedient to design the recess 26 with the stop shoulder 28 only at one roller 20 of the roller pair 3. Tests have also demonstrated the attachment of a flywheel 65 on the side opposite the one-stop clutch 41 to be expedient in ensuring that the angle of rotation at which the shafts 22, 23 are stopped in the normal position is maintained more accurately.

Instead of the one-stop clutch 41, a servomotor with angle feedback can also be used, for example, as the drive 4 for the roller pairs 3. If the rollers 20, 21 have a large circumference, they can also have two or three recesses 26, 27 at constant angular intervals, wherein the shafts 22, 23 rotate by an integral multiple of 180° or 120°.

If the apparatus is attached directly to a printer, which labels individual sheets, instead of the reader 60 a signal from the printer or a preceding computer can also be used to initiate the expulsion of the bundle 55. Of course, in response to a suitable signal, just the first delivered sheet can be carried away by the roller pairs 3.

Figure 5:
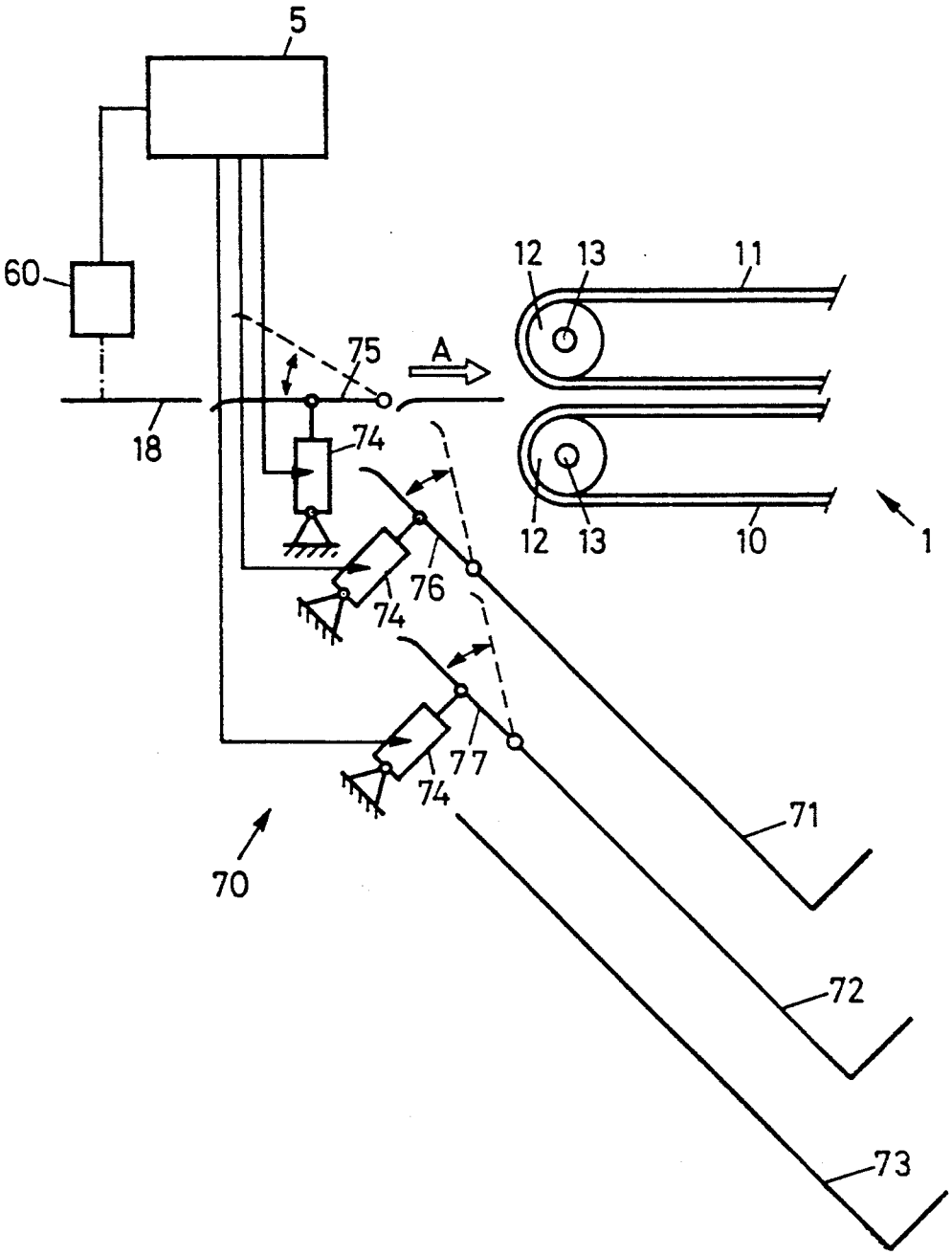
FIG. 5 shows a valve preceding the apparatus.

FIG. 5 shows the apparatus with a preceding valve or switch arrangement 70, by means of which individual sheets 2 or series of sheets can be discharged into three different receptacles 71, 72, 73. The necessary three pivotable switch plates 75, 76, 77, which are operated, e.g. by electromagnets 74, can also be controlled by output signals from the reader 60. Thus, sheets 2 or series of sheets, which are not to be further processed in a folding or envelope stuffing machine can be discharged and gathered separately. The switch arrangement that is shown requires unusually little space in the conveying direction A.

I claim:

1. An apparatus for gathering individual sheets (2) of paper into a bundle or stack (55) of multiple sheets, and for discharging the bundle, said apparatus comprising:

a) feed means (1) for feeding the sheets in a conveying direction (A);

b) a pair of transport rollers (3), including a first roller (20) and a second roller (21), opposite said first roller, wherein the circular cylindrical outer circumference of at least the first roller defines a first wedge-shaped recess (26) with a first stop shoulder (28) for the front edge of incoming sheets which are supplied by the feed means, and which lies in a plane containing the axis of the first roller (20), said plane being approximately perpendicular to the conveying direction when the first roller is in a rest position;

c) drive means (b), having a drive shaft (22) fixedly connected to at least the first roller for rotation therewith; and d) a controller (5) for activating the drive means in response to input signals such that the first roller rotates out of its rest position to discharge a bundle of sheets, and subsequently returns to and is halted at the rest position, e) wherein the feed means is formed by a plurality of continuous, rotational, lower and upper cords (10, 11), and the rollers are arranged between the cords, and further comprising:

f) at least one rear edge stop (51) projecting above the upper cords, arranged between the cords, having a stop face (53) facing the pair of transport rollers (3) and lying perpendicular to the conveying direction, and defining an abutting surface (54) which is sloped in the conveying direction for lifting an infed sheet above sheets already resting against the stop shoulder.

2. An apparatus as claimed in claim 1, wherein the second roller defines a second recess (27) which is mirror symmetrical with respect to the first recess, with a second stop shoulder (29) which aligns with the first stop shoulder in the rest position of the rollers, and wherein the rollers are operatively coupled together for rotation in opposite directions.

3. An apparatus as claimed in claim 1, wherein sensing means (61) is disposed upstream of the rear stop (51) for scanning the rear edge of a last sheet of a bundle and for triggering the drive means.

4. An apparatus as claimed in claim 1, wherein the drive means includes a normally engaged one-stop clutch (41), and the controller includes a releasing member (46) for releasing the clutch.

5. An apparatus as claimed in claim 4, wherein the controller includes a sensor (62) disposed immediately downstream of the rollers (20, 21), said sensor holding the releasing member activated until the rear edge of a discharged bundle has passed the sensor.

6. An apparatus as claimed in claim 1, wherein the controller (5) contains an infed sheet reader (60) for activating the drive means.

7. An apparatus as claimed in claim 1, further comprising a gate arrangement (70) for selectively discharging sheets, said gate arrangement being disposed preceding the feed means.

8. An apparatus for gathering individual sheets (2) of paper into a bundle or stack (55) of multiple sheets, and for discharging the bundle, said apparatus comprising:

a) feed means (1) for feeding the sheets in a conveying direction (A);

b) a pair of transport rollers (3), including a first roller (20) and a second roller (21), opposite said first roller, wherein the circular cylindrical outer circumference of at least the first roller defines a first wedge-shaped recess (26) with a first stop shoulder (28) for the front edge of incoming sheets which are supplied by the feed means, and which lies in a plane containing the axis of the first roller (20), said plane being approximately perpendicular to the conveying direction when the first roller is in a rest position;

c) drive means (4), having a drive shaft (22) fixedly connected to at least the first roller for rotation therewith; and d) a controller (5) for activating the drive means in response to input signals such that the first roller rotates out of its rest position to discharge a bundle of sheets, and subsequently returns to and is halted at the rest position, e) wherein the second roller defines a second recess (27) which is mirror symmetrical with respect to the first recess, with a second stop shoulder (29)

which aligns with the first stop shoulder in the rest position of the rollers, and wherein the rollers are operatively coupled together for rotation in opposite directions.

9. An apparatus for gathering individual sheets (2) of paper into a bundle or stack (55) of multiple sheets, and for discharging the bundle, said apparatus comprising:

a) feed means (1) for feeding the sheets in a conveying direction (A);

b) a pair of transport rollers (3), including a first roller (20) and a second roller (21), opposite said first roller, wherein the circular cylindrical outer circumference of at least the first roller defines a first wedge-shaped recess (26) with a first stop shoulder (28) for the front edge of incoming sheets which are supplied by the feed means, and which lies in a plane containing the axis of the first roller (20), said plane being approximately perpendicular to the conveying direction when the first roller is in a rest position;

c) drive means (4), having a drive shaft (22) fixedly connected to at least the first roller for rotation therewith; and d) a controller (5) for activating the drive means in response to input signals such that the first roller rotates out of its rest position to discharge a bundle of sheets, and subsequently returns to and is halted at the rest position, e) wherein the drive means includes a normally engaged one-stop clutch (41), and the controller includes a releasing member (46) for releasing the clutch, and f) wherein the controller includes a sensor (62) disposed immediately downstream of the rollers (20, 21), said sensor holding the releasing member activated until the rear edge of a discharged bundle has passed the sensor.

* * * * *